US008240352B2

(12) United States Patent
Gambini

(10) Patent No.: US 8,240,352 B2
(45) Date of Patent: Aug. 14, 2012

(54) GROUP FOR GLUING THE FINAL EDGE OF A LOG

(75) Inventor: Giovanni Gambini, Pisa (IT)

(73) Assignee: Gambini International S.A., Luxembourg (LU)

( * ) Notice: Subject to any disclaimer, the term of this patent is extended or adjusted under 35 U.S.C. 154(b) by 89 days.

(21) Appl. No.: 12/718,323

(22) Filed: Mar. 5, 2010

(65) Prior Publication Data

US 2010/0224326 A1 Sep. 9, 2010

(30) Foreign Application Priority Data

Mar. 6, 2009 (IT) ..... MI2009A0337

(51) Int. Cl.
*B29C 53/56* (2006.01)

(52) U.S. Cl. ..... 156/356; 156/361; 156/446; 156/449; 156/455

(58) Field of Classification Search ..... 156/184, 156/356, 357, 361, 446, 449, 450, 454, 455
See application file for complete search history.

(56) References Cited

U.S. PATENT DOCUMENTS

| | | | | |
|---|---|---|---|---|
| 5,643,398 | A * | 7/1997 | Lumberg | 156/446 |
| 5,759,326 | A | 6/1998 | Vigneau | |
| 2005/0284557 | A1 * | 12/2005 | Gambini | 156/64 |

FOREIGN PATENT DOCUMENTS

| | | | |
|---|---|---|---|
| EP | 0541496 | A | 5/1993 |
| EP | 1197453 | A | 4/2002 |
| EP | 1440925 | A | 7/2004 |
| EP | 1609534 | A | 12/2005 |

* cited by examiner

*Primary Examiner* — Michael Tolin
(74) *Attorney, Agent, or Firm* — Lucas & Mercanti, LLP

(57) ABSTRACT

A gluing group of a final edge of a log including in succession an introducing group into the gluing group of the logs one after the other, an unwinding group of the log associated with means for identifying the final edge, an opening group of the final edge from the log and a glue transfer group on the log, in which the opening group of the final edge and the glue transfer group are housed in a slide structure that is mobile with respect to the unwinding group by a predetermined amount dependent upon the diameter of the log, with rolling transfer means of the log from the unwinding group to the slide structure being foreseen.

13 Claims, 3 Drawing Sheets

GROUP FOR GLUING THE FINAL EDGE OF A LOG

CROSS-REFERENCE TO RELATED APPLICATION

This application claims the benefit of priority from Italian Patent Application No. MI2009A 000337, filed Mar. 6, 2009, the contents of which are incorporated herein by reference.

FIELD OF THE INVENTION

The present invention refers to an improved gluing group of the final edge of a log.

BACKGROUND OF THE INVENTION

Nowadays, machines for gluing the final edge of logs, fed one after the other, are known.

Such machines commonly comprise in succession, i.e. following the advancing direction of the logs, a station for unwinding the logs in which the final edge is identified, a station in which such an edge is held and a station in which the log receives the glue at an inner layer of paper with respect to that defined by the final edge.

Some known machines also comprise a station, downstream of the dispensing station of the glue, for rewinding the final edge on the log where, thanks to the glue transferred in the previous station, the final edge is fixed to the rest of the log.

Without such a rewinding station the edge is fixed to the rest of the log by simply advancing by rolling of the log itself downstream of the glue dispensing station.

The stations in which the final edge is held upstream of the glue dispensing station comprise a suction element which has the purpose of holding the final edge moving it away from the log for a predetermined length before glue is dispensed on the log itself.

Of course, in order to ensure such an aforementioned operation, it is necessary for the final free edge of the log to come into contact with the suction element.

Indeed, otherwise, i.e. no contact of the final edge with the suction element, it could happen that the edge is not moved away from the log and consequently glue is dispensed on the outer surface of the log itself.

Disadvantageously, in such conditions, the final edge is not glued onto the log and glue is spread on the parts of the machine that could also ruin the following logs.

As well as ensuring the contact of the final edge with the suction element, there is a further advantage if the first contact of the log with the suction element occurs right at such a final edge, that is to say, if the log reaches the suction element timed with the edge arranged at "6 O'clock".

Indeed, in this case, the time the suction element is "occupied" by the log is reduced to the minimum thus optimizing the production of finished logs per hour.

Analysing the operation of moving away the final edge, it requires an unavoidable period of time, which starts with the contact of the final edge with the suction element and ends when it has reached a predetermined length away from it, as well as a possible time for the suction element to "search" for the edge.

It should be clear that such a time searching for the edge is an unnecessary waste of time and it slows down production.

In particular, the time searching for the edge occurs when the first contact with the suction element does not occur at the final free edge, delaying the moment when the predetermined distance away of the edge itself has been reached, at which the log is made to advance on the glue dispenser.

In order to ensure that the first contact of the log with the suction element occurs at the final edge, known machines comprise devices called "timing devices" arranged upstream of the suction element which have the special function of arranging the final edge on the log in a particular angular position according to the diameter of the log and to the distance between the timing devices themselves and the suction element.

As the diameter of the log varies, the timing means must impose on the final edge a different particular angular position before making it advance so as to always ensure that the first contact of the log with the suction element occurs at the final edge itself.

In a first known embodiment such timing means comprise a pair of rollers or belts arranged between the unwinding station and the gluing station.

In other known embodiments, the timing means are integrated in the unwinding station and comprise photocells and suitably oriented blowing elements.

However, both aforementioned solutions have some drawbacks. Indeed the presence of rollers or belts between the unwinding station and the gluing station necessarily increases the time needed for the processing of the single logs, whereas, unwinding stations integrated with the timing means slow down the production of the finished logs per hour holding the single logs also for the time required by the aforementioned timing.

SUMMARY OF THE INVENTION

The purpose of the present invention is that of making an improved gluing group of the final edge of a log that is able to solve the aforementioned drawbacks of the prior art in an extremely simple, cost effective and particularly functional manner.

Another purpose is that of making an improved gluing group of the final edge of a log that is extremely rapid and that can be adapted to any size of logs fed.

Yet another purpose is that of being able to have an improved gluing group of the final edge of a log in which, without intermediate stations between the unwinding and the gluing stations and irrespective of the size of the logs fed, the first contact of the log with the suction element of the holding station always occurs at the final edge.

Yet another purpose is that of being able to have an improved gluing group of the final edge of a log in which the unwinding station proceeds to make the log advance when the final edge is in a pre-determined position irrespective of the size of the logs fed.

These purposes according to the present invention are achieved by making an improved gluing group of the final edge of a log as outlined in claim 1.

Further characteristics of the invention are highlighted in the subsequent claims.

BRIEF DESCRIPTION OF THE DRAWINGS

The characteristics and the advantages of an improved gluing group of the final edge of a log according to the present invention shall become clearer from the following description, given as an example and not for limiting purposes, with reference to the attached schematic drawings in which.

DETAILED DESCRIPTION OF THE INVENTION

Figure 1:
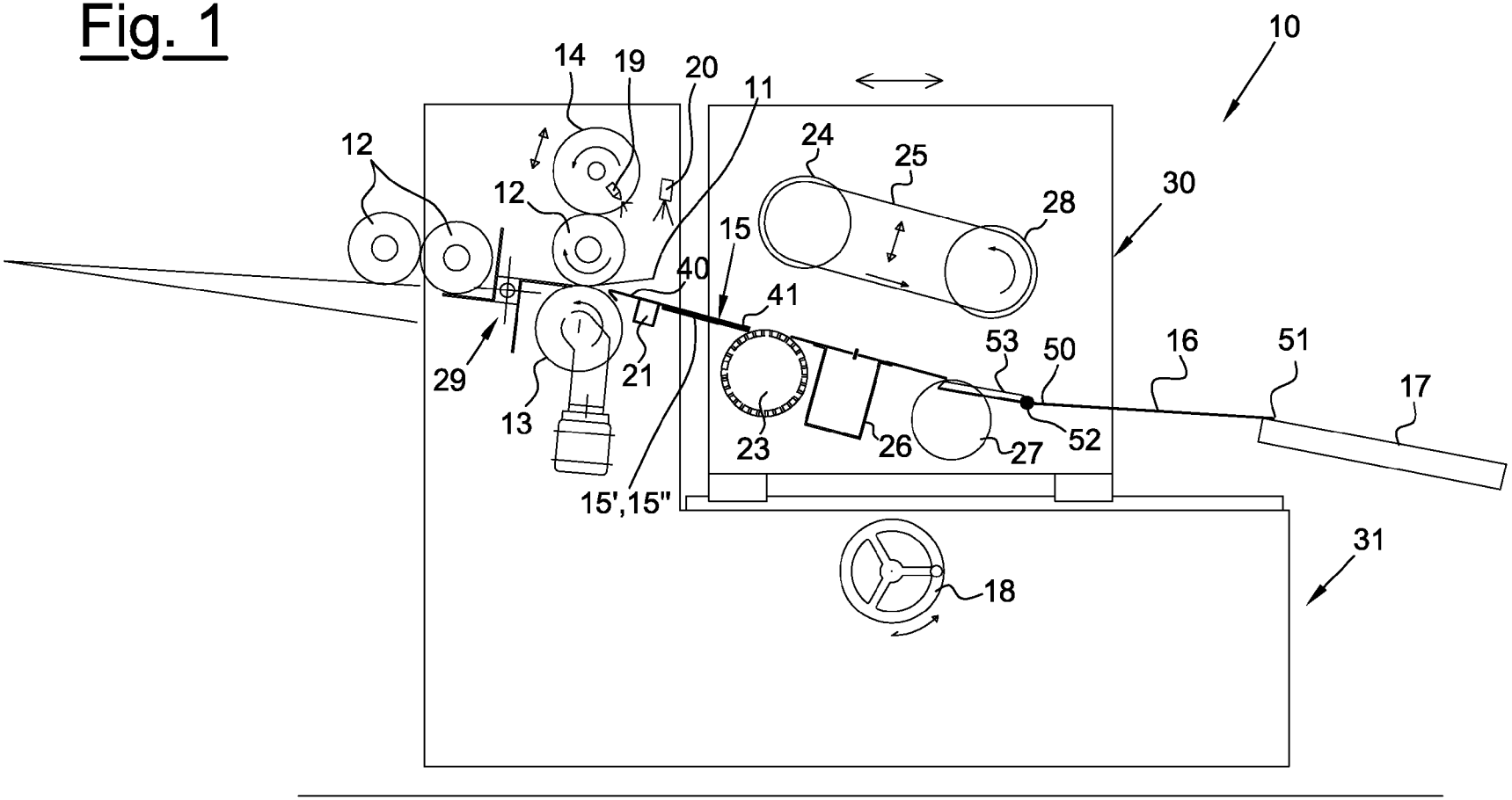
FIG. 1 is a side elevational view, partially in section, of one example embodiment of an improved gluing group of the final edge of a log according to the present invention.

With reference to the figures, an improved gluing group of the final edge of a log according to the present invention is shown with reference numeral 10.

Such gluing group 10 comprises in succession a group 29 for introducing logs 12 one after the other, a group for unwinding them associated with means for identifying a final edge 11, an opening group of the final edge 11 from the relative log 12 and a glue transfer group 26 on an inner layer of the same log 12 of which the final edge has been held.

In particular, according to the invention, the opening group of the final edge 11 and the glue transfer group 26, which as described above cooperate during the dispensing of the glue, are housed in a slide structure 30 mobile with respect to the unwinding group, possibly housed in a fixed structure 31, by a predetermined amount and dependent upon the diameter of the log 12.

Rolling transfer means 15 of the log 12 from the unwinding group to the slide structure 30 are also foreseen, irrespective of its position with respect to the unwinding group.

According to a first embodiment, the transfer means 15 of the log 12, from the unwinding group to the slide structure 30, comprise a first and second inclined free-rolling plane 15', 15" of the log 12, in which the first inclined plane 15' comprises an initial end 40 fixedly connected downstream of the unwinding group whereas the second inclined plane 15" comprises a final end 41 fixedly connected upstream of the opening group.

Figure 2:
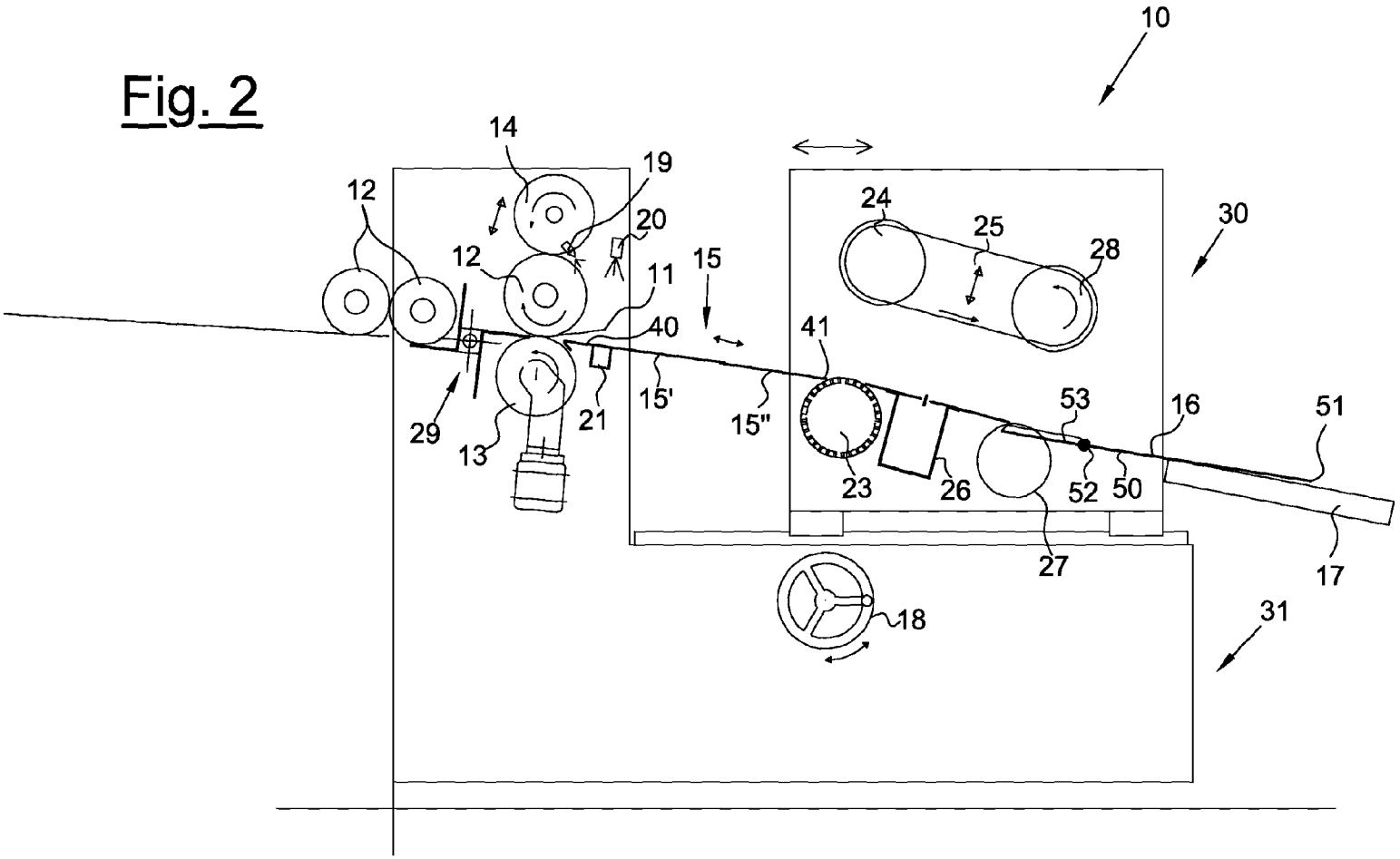
FIG. 2 is a side elevational view, partially in section, of the group of FIG. 1 fed with logs having greater size with respect to those of FIG. 1.

Such a first and second inclined plane 15', 15" are able to slide one 15" on top of the other 15' during the movement of the slide structure 30 starting from a first position, shown in FIG. 1, in which they are substantially overlapped up to a second position, FIG. 2, in which they are only partially overlapped.

Figure 2B:
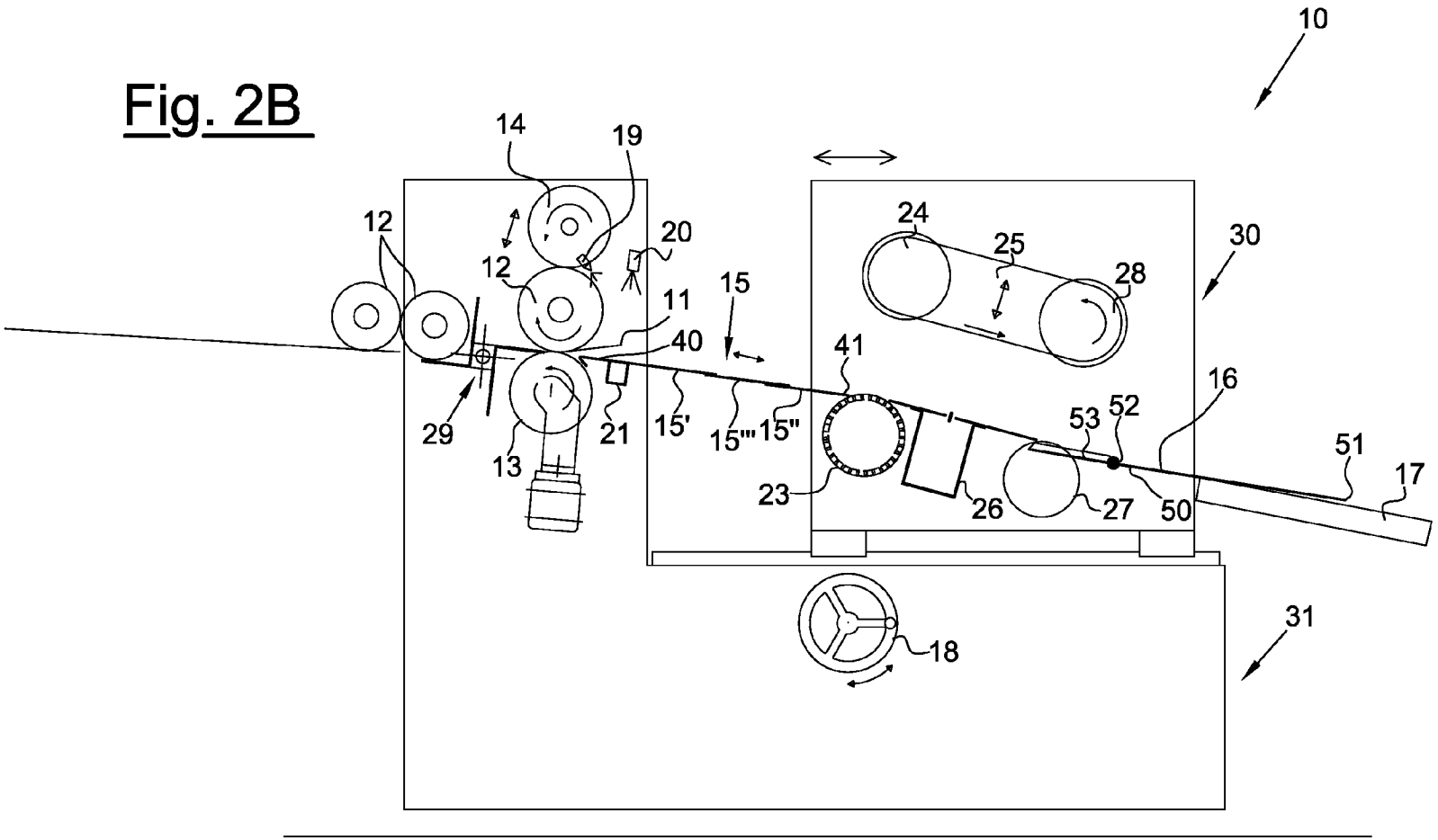
FIG. 2B is a side elevational view, partially in section, of another example embodiment of an improved gluing group of the final edge of a log according to the present invention.

According to another embodiment, shown in FIG. 2B, the transfer means 15 comprise at least a third inclined plane 15'" arranged between the previous first and second inclined plane 15', 15", in which the at least third inclined plane 15'" is able to slide, with respect to the first and second inclined plane 15', 15", during the movement of the slide structure 30.

Therefore, in such an embodiment the transfer means 15 are mobile starting from a first position in which all three inclined planes 15', 15", 15'" are substantially overlapped up to a second position in which they are only partially overlapped.

In the examples shown in the figures the unwinding group comprises a pair of rollers 13, 14, top 14 and bottom 13, respectively, such as to make a passage for the log 12.

Such a pair of rollers 13, 14 is selectively for advancing and for holding in rotation the log 12.

According to such an embodiment, the initial end 40 of the first inclined plane 15' is associated downstream of the lower unwinding roller 13.

Again with reference to the example embodiment shown in the figures, the opening group of the final edge 11 from the log 12 comprises a pair of rollers 23, 24, top 24 and bottom 23, respectively, such as to make a passage for the log 12.

Such a pair of rollers 23, 24 is selectively for advancing and for holding in rotation the log 12 in which the lower roller 23 is of the sucked type to hold and move the final edge 11 away from the rest of the log 12.

According to such an example embodiment, the final end 41 of the second inclined plane 15" is associated upstream of the lower sucked roller 23.

As mentioned at the beginning of the description, the glue transfer group 26, shown only schematically in the figures, transfers glue on one inner layer of paper of the log whereas the lower sucked roller 23 holds and brings the final edge 11 away from the rest of the log 12.

In order to facilitate such a cooperation, an upper belt 25 can be foreseen downstream of the top roller 24 for advancing of the log 12 towards the glue transfer group 26, while the lower sucked roller 23 holds and moves the final edge 11 away.

Associated with the unwinding group it is foreseen for there to be means for identifying the final edge 11, which in particular are able to control the advancing of the log in the group 10 at the passage of the edge 11 in a particular detection point.

In other words, when the aforementioned identifying means detect the final edge 11, irrespective of the size of the log 12, they control the turning off of the lower roller 13, imposing the advancing of the log 12 towards the glue transfer group 26.

With reference to the example embodiments shown in the figures, means for identifying the final edge 11 comprise a blowing element 19 associated with the top roller 14 suitable for unwinding the final edge 11 on the initial end 40 of the first inclined plane 15', a photocell 20 for detecting the final edge 11 laid out on the plane 15' and a suction box 21 for keeping the laid out final edge 11 associated with the initial end 40 of the first inclined plane 15'.

The group 10 according to the present invention can also comprise an expulsion group of the logs 12 comprising a fixed support plane 17 arranged externally downstream of the slide structure 30 and transfer means 16 of the glued logs 12 from the slide structure 30 to the fixed support plane 17.

For example the transfer means 16 can comprise a tilting inclined plane 16 provided with a first initial end 50 fixedly connected to the slide structure 30 in a pin 52 downstream of the glue transfer group 26 and a second final end 51 able to slide on the fixed support plane 17 during the movement of the slide structure 30.

Preferably, the slide 30 also houses a winding group of the final edge 11 on the relative log 12 downstream of the glue transfer group 26, comprising a pair of rollers 27, 28 top 28 and bottom 27, respectively, to make a passage for the log 12.

Such a pair of rollers 27, 28 is selectively for advancing and for holding in rotation the log 12.

In such an example the first initial end 50 of the tilting inclined plane 16 is fixedly connected downstream of a plane 53 fixedly attached with respect to the lower winding roller 27.

In order to control and command the movement of the slide structure 30 with respect to the unwinding group any type of means, for example automatic or manual, can be foreseen.

In the figures, an example of manual moving means of the slide structure 30, such as a manually rotated fly wheel 18, is shown.

It should be very easy to understand how the improved gluing group of the final edge of a log object of the present invention works.

The means for identifying the edge associated with the unwinding group of the edge 11 command the advancing of the log 12 to the detection of the edge 11 irrespective of the size of the log 12 to be glued, thus rapidly freeing the unwinding group for both small logs 12 and big ones.

In order for such an edge 11 to always be the first portion of the log 12 to come into contact with the sucked element of the unwinding group, the slide structure 30 is positioned in a position such as to ensure such a first coupling according to the size of the log 12.

In other words, the group 10 according to the present invention does not proceed to phase shift the log, holding it in a suitable station, but moves the slide structure 30 away from or closer to it so that after a complete rotation of the log 12, the final edge 11, that comes out from the unwinding group, always in the same position irrespective of the size of the log 12, comes into contact with the sucked element of the unwinding group arranged at "6 O'clock" with respect to the log 12 itself.

Therefore, since the slide structure 30 takes on a different distance from the unwinding group depending on the size of the log 12, the transfer means 15 comprise at least two sliding planes 15' 15" respectively fixedly connected to the unwinding group and to the slide structure 30.

By keeping the distance between the unwinding group and the group for moving away the edge 11 equal to the circumference of the moving log 12, so that the log 12 itself carries out a single complete rotation in such a portion, for small sized logs, FIG. 1, the sliding planes 15' 15" are overlapped and the slide structure 30 is close to the unwinding group, whereas for larger size logs 12, FIG. 2, the sliding planes 15' 15" are arranged only partially overlapped to connect the unwinding group and the slide structure 30 with each other.

In order to allow also big sized logs 12 to be glued, therefore in which, according to what has previously been described, the distance between the unwinding group and the slide structure 30 is substantial, the invention also foresees at least one third plane 15''' able to slide between the previously mentioned ones 15' 15" so as to ensure the correct advancing of the log 12 even for such cases.

It is of course also possible, according to the invention, for the logs 12 to carry out even more rotations on the transfer means 15, i.e. they can cover a distance equal to a multiple of their circumference by rolling.

Finally, in order to allow a correct expulsion of the log 12 glued by the slide structure 30 in each position it is able to take up, a tilting plane 16 is foreseen equipped with an end 50 fixedly connected so as to be able to rotate around a pin 52 fixedly attached to the slide structure 30 and with another opposite end 51 able to slide on a fixed plane 17.

It has thus been seen that an improved gluing group of the final edge of a log according to the present invention achieves the purposes previously highlighted.

Indeed the improved gluing group of the final edge of a log according to the present invention is extremely rapid irrespective of the size of the logs fed since it does not comprise any holding step of the log intended to arrange the final edge in a particular angular position (the so called "timing") on the log according to the size of the logs fed.

Moreover, the improved gluing group of the final edge of a log according to the present invention irrespective of the size of the logs fed ensures that the first contact of the log with the suction element of the holding station always occurs at the final edge rapidly freeing both the unwinding station and the station for moving away the final edge.

The improved gluing group of the final edge of a log according to the present invention thus conceived can undergo numerous modifications and variants, all covered by the same inventive concept; moreover, all the details can be replaced by technically equivalent elements. In practice the materials used, as well as their sizes, can be any according to the technical requirements.

The invention claimed is:

1. A gluing apparatus for gluing a final edge of logs, which are introduced into said gluing apparatus one after another, said gluing apparatus comprising:

a fixed structure;

a means for identifying said final edge of said logs;

an unwinding apparatus, which is associated with said means for identifying said final edge of said logs and which opens said final edge of said logs;

a slide structure;

glue transfer apparatus, which is housed in said slide structure, being mobile with respect to said unwinding apparatus by a predetermined amount dependent upon a diameter of said logs; and a rolling transfer means for transferring said logs from said unwinding apparatus to said slide structure.

2. A gluing apparatus for gluing a final edge of logs, which are introduced into said gluing apparatus one after another, said gluing apparatus comprising:

a fixed structure;

a means for identifying said final edge of said logs housed in said fixed structure;

an unwinding apparatus, which is associated with said means for identifying said final edge of said logs and which opens said final edge of said logs, being housed in said fixed structure, said unwinding apparatus comprises a pair of rollers, a top roller and a bottom roller respectively, to make a passage for said logs, said pair of rollers being capable of selectively advancing said logs and selectively holding said logs in rotation;

a slide structure;

a glue transfer apparatus, which is housed in said slide structure, being mobile with respect to said unwinding apparatus by a predetermined amount dependent upon a diameter of said logs; and a rolling transfer means for transferring said logs from said unwinding apparatus to said slide structure, said rolling transfer means comprises at least a first free-rolling inclined plane and a second free-rolling inclined plane, said first free-rolling inclined plane has an initial end fixedly connected downstream of said bottom roller of said unwinding apparatus, said second free-rolling inclined plane has a final end fixedly connected upstream of said glue transfer apparatus, said first free-rolling inclined plane and said second free-rolling inclined plane, are able to slide on top of each other during a movement of said slide structure starting from a first position in which said first free-rolling inclined plane and said second free-rolling inclined plane are substantially overlapped up to a second position in which said first free-rolling inclined plane and said second free-rolling inclined plane are only partially overlapped.

3. The gluing apparatus according to claim 2, wherein said rolling transfer means comprises at least a third inclined plane arranged between said first free-rolling inclined plane and said second free-rolling inclined plane, said at least a third free-rolling inclined plane being slideable with respect to said first free-rolling inclined plane and said second free-rolling inclined plane during a movement of said slide structure starting from said first position in which said first free-rolling inclined plane and said second free-rolling inclined are substantially overlapped up to said second position in which said first free-rolling inclined plane and said second free-rolling inclined are only partially overlapped.

4. The gluing apparatus according to claim 2, wherein said bottom roller of said unwinding apparatus is sucked up to hold said final edge of said logs, and said final end of said second free-rolling inclined plane is located upstream of said bottom roller of said unwinding apparatus.

5. The gluing apparatus according to claim 3, wherein said bottom roller of said unwinding apparatus is sucked up to hold said final edge of said logs, and said final end of said second free-rolling inclined plane is located upstream of said bottom roller of said unwinding apparatus.

6. The gluing apparatus according to claim 4, wherein said gluing apparatus comprises an upper belt downstream of said roller in collaboration with said bottom roller for advancing said logs at said glue transfer apparatus.

7. The gluing apparatus according to claim 5, wherein said gluing apparatus comprises an upper belt downstream of said roller in collaboration with said bottom roller for advancing said logs at said glue transfer apparatus.

8. The gluing apparatus according to claim 2, wherein said means for identifying said final edge of said logs comprises a blowing element associated with said roller for unwinding said final edge on said plane, a photocell for detecting said final edge of said logs laid out on said plane and a suction box for keeping said final edge of said logs laid out on said initial end of said first free-rolling inclined plane.

9. The gluing apparatus according to claim 3, wherein said means for identifying said final edge of said logs comprises a blowing element associated with said roller for unwinding said final edge of said logs on said plane, a photocell for detecting said final edge of said logs laid out on said plane and a suction box for keeping said final edge of said logs laid out on said initial end of said first free-rolling inclined plane.

10. The gluing apparatus according to claim 2, wherein said gluing apparatus comprises an expulsion apparatus for said logs comprising a fixed support plane arranged outside downstream of said slide structure and a transfer means for said logs from said slide structure to said fixed support plane.

11. The gluing apparatus according to claim 10, wherein said transfer means of said log from said slide structure to said fixed support plane comprises a tilting inclined plane, and said tilting inclined plane comprises a first initial end fixedly connected to said slide structure downstream of said glue transfer apparatus and a second final end able to slide on said fixed support plane during the movement of said slide structure.

12. The gluing apparatus according to claim 11, wherein said gluing group comprises a winding apparatus for said final edge of said logs downstream of said glue transfer apparatus comprising a pair of rollers, top and bottom respectively, to make a passage for said log, said pair of rollers being selective for advancing and for holding in rotation said logs, and said first initial end of said tilting inclined plane fixedly connected downstream of said lower roller.

13. The gluing apparatus according to claim 2, wherein said gluing group comprises means for moving said slide structure.

* * * * *